United States Patent [19]

Fujiwara et al.

[11] 4,374,978

[45] Feb. 22, 1983

[54] HIGH YOUNG'S MODULUS POLY-P-PHENYLENE TEREPHTHALAMIDE FIBER

[75] Inventors: Takashi Fujiwara, Miyazaki; Shuji Kajita, Osaka; Tetsuo Matsushita, Miyazaki; Seiichi Manabe, Osaka, all of Japan

[73] Assignee: Asahi Kasei Kogyo Kabushiki Kaisha, Japan

[21] Appl. No.: 129,404

[22] Filed: Mar. 11, 1980

[30] Foreign Application Priority Data

Mar. 13, 1979 [JP] Japan ..... 54-29115

[51] Int. Cl.[3] ..... C08G 69/46

[52] U.S. Cl. ..... 528/348; 264/184; 528/336

[58] Field of Search ..... 528/348

[56] References Cited

U.S. PATENT DOCUMENTS

| | | | |
|---|---|---|---|
| 3,227,793 | 1/1966 | Cipriani | 264/203 |
| 3,817,941 | 6/1974 | Bair et al. | 528/348 |
| 3,819,587 | 6/1974 | Kwolek | 528/348 |
| 3,869,429 | 3/1975 | Blades | 528/348 |
| 3,869,430 | 3/1975 | Blades | 264/184 |
| 4,016,236 | 4/1977 | Nagasawa et al. | 264/184 |

OTHER PUBLICATIONS

English Translation of claims 1–3, Japanese Patent Application 143724/1976.

English Translation of claims 1–4, Japanese Patent Publication 37473/1978.

*Primary Examiner*—Harold D. Anderson

*Attorney, Agent, or Firm*—Finnegan, Henderson, Farabow, Garrett & Dunner

[57] ABSTRACT

A high Young's modulus poly-p-phenylene-terephthalamide fiber having a unique fine-structure and excellent properties, including excellent resistance to lateral stress and to friction. The fiber is made by extruding an anisotropic dope in a non-coagulating layer, passing the extrudate through a coagulating layer, washing and drying the resulting coagulated fibers in the absence of substantial tension, and heating the fibers under tension.

9 Claims, 4 Drawing Figures

FIG. 1
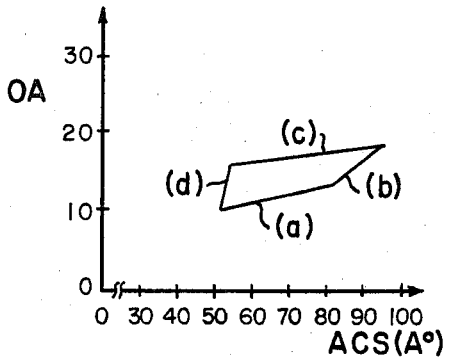
FIG. 2
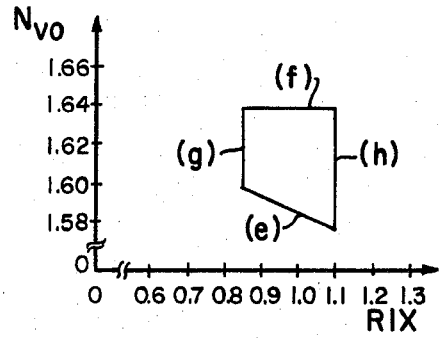
FIG. 3
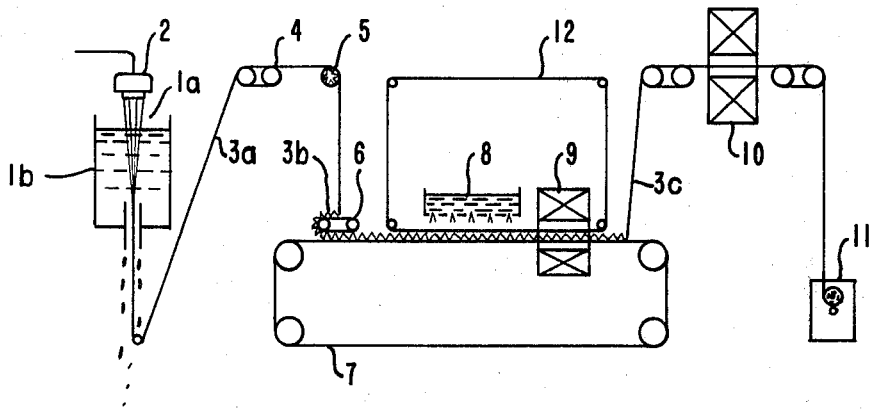
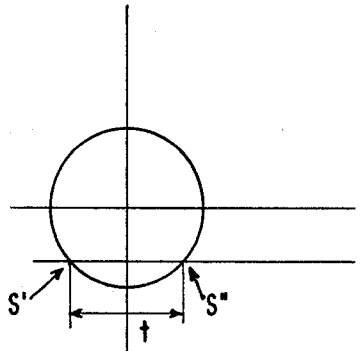
FIG. 4(A)
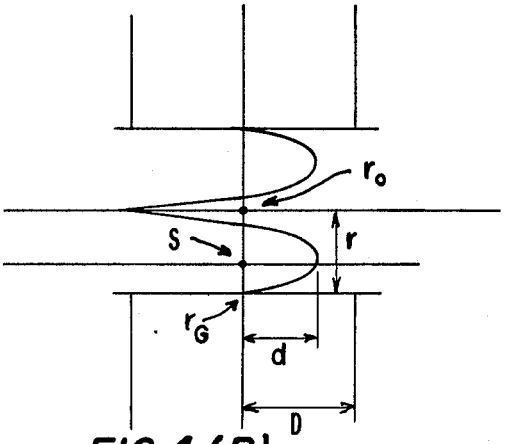
FIG. 4(B)

HIGH YOUNG'S MODULUS POLY-P-PHENYLENE TEREPHTHALAMIDE FIBER

BACKGROUND OF THE INVENTION

The present invention relates to improved poly-p-phenylene-terephthalamide (hereinafter referred to as "PPTA") fibers and a process for their preparation. More particularly, the invention relates to high tenacity, high Young's modulus PPTA fibers useful for reinforcing plastics and rubbers, and a process for their preparation.

PPTA is a polymer that has been known for many years and, from the rigid molecular structure of this polymer, it has been expected that its fibers would have excellent heat resistance and mechanical properties. However, PPTA is only slightly soluble or insoluble in organic solvents. Accordingly, Cypriani proposed a basic process for wet-spinning PPTA by using concentrated sulfuric acid as a solvent (U.S. Pat. No. 3,227,793), but Cypriani's process itself was not industrialized.

It has been known for many years that when a rigid polymer is dissolved in a solvent, a liquid crystal is formed at a degree of polymerization exceeding a certain level and a concentration exceeding a certain level under a certain temperature condition, and this phenomenon has been confirmed theoretically and experimentally (P. J. FLORY; Proc. Roy. Soc., A234, 73 (1956)). It is easily predicted that if a polymer solution that is in the form of a liquid crystal and is optically anisotropic can be extruded from a nozzle and coagulated while preventing disturbance of orientation of the liquid crystal in the interior of the nozzle as much as possible, fibers having high tenacity and high Young's modulus and comprising highly oriented molecular chains will be obtained. In fact, Kwoleck proposed a process for the wet spinning of a concentrated solution of an aromatic polyamide having a rigid and linear molecular structure that is in the form of a liquid crystal (U.S. Pat. No. 3,819,587), and this type of wet spinning process again attracted attention in the art.

Blades proposed a process in which an optically anisotropic dope having an elevated concentration is extruded in air and then wet-spun to form as-spun fibers having a high tenacity owing to a specific fine-structure in the as-spun state (U.S. Pat. Nos. 3,767,756 and 3,869,429), and Blades further taught that if such as-spun fibers are heat-treated under tension, the Young's modulus can be enhanced (U.S. Pat. No. 3,869,430).

However, it has been pointed out that the above-mentioned high Young's modulus fibers to be used for reinforcing plastics or certain special rubbers have the following defects. That is, PPTA fibers having a Young's modulus elevated to a level exceeding about 600 g/d are poor in resistance to stress imposed in the lateral direction and resistance to friction on the surfaces of the fibers and, therefore, are readily fibrillated (see, for example, S. L. Fennix et al.; Textile Res. J. Dec., 934 (1974)). Accordingly, if these PPTA fibers are twisted to produce yarns practically applicable as reinforcing fibers, they are fibrillated owing to frictional contact with guides or the like and yarn dust is formed. Furthermore, when they are embedded in rubber belts or plastics as reinforcers and applied to a use where stress is repeatedly imposed, no satisfactory fatigue resistance can be attained.

Various improvements have been proposed in the preparation of high Young's modulus fibers of para-oriented aromatic polyamides inclusive of PPTA (see, for example, Japanese Patent Application Laid-Open Specifications No. 12325/77, No. 12326/77 and 98415/78), but these proposals have failed to overcome the above-mentioned problems.

SUMMARY OF THE INVENTION

With a view to improving the resistance in the lateral direction of PPTA fibers having a high tenacity and very high Young's modulus exceeding about 600 g/d, the inventors of the present invention conducted research regarding the relation between the fine-structure and physical properties in these PPTA fibers, and found that fibers having not only a specific crystalline structure but, also, a specific structure in amorphous regions are satisfactory. It was also found that fibers having such specific fine-structure can be obtained by washing and drying as-spun fibers in the absence of substantial tension, which was already disclosed in U.S. Pat. No. 4,016,236, and then heat treating the thus washed and dried fibers under tension at a specific temperature. The present invention is based on these findings.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, and in accordance with one fundamental aspect of the present invention, there is provided a high Young's modulus fiber consisting essentially of poly-p-phenylene-terephthalamide, wherein the tangential refractive index (TRIv) of the fiber by polarized light vibrating in the direction perpendicular to the fiber axis is in the range of from 0.06 to 0.10, the tangential refractive index (TRIp) of the fiber by polarized light vibrating in the direction parallel to the fiber axis is in the range of from −0.020 to +0.020, the central refractive index (Nvo) of the fiber by polarized light vibrating in the direction perpendicular to the fiber axis and the X-ray diffraction indensity ratio (RIX) are in the range satisfying the conditions of the formulae (1) through (4):

$$Nvo \geqq -0.08(RIX)+1.670 \quad (1)$$

$$Nvo \leqq 1.640 \quad (2)$$

$$RIX \geqq 0.85 \quad (3)$$

$$RIX \leqq 1.10 \quad (4),$$

and the apparent crystallite size (ACS in Å) of the fiber and the orientation angle (OA in degrees) of the fiber are in the range satisfying the conditions of the formulae (5) through (8):

$$OA \geqq 0.10(ACS)+4.8 \quad (5)$$

$$OA \geqq 0.40(ACS)-19.8 \quad (6)$$

$$OA \leqq 0.05(ACS)+13.3 \quad (7)$$

$$OA \leqq 3(ACS) - 146 \quad (8).$$

In accordance with another fundamental aspect of the present invention, the above-mentioned fibers are prepared by a process comprising extruding an anisotropic dope of a polymer consisting essentially of poly-p-phenylene-terephthalamide in concentrated sulfuric acid having a concentration of at least 98% by weight in a non-coagulating layer, passing the extrudate through a coagulating layer, depositing the resulting coagulated fibers on a net conveyor, in the absence of substantial tension washing of the fibers to remove sulfuric acid and drying the fibers, releasing the fibers from the tension-free state, and heating the fibers under tension at a temperature of 200° to 500° C.

The accompanying drawings, which are incorporated in and constitute a part of this specification, illustrate the invention and, together with the description, serve to explain the principles of the invention.

BRIEF DESCRIPTION OF THE DRAWINGS

FIGS. 1 and 2 are diagrams illustrating the fine-structural characteristic of the fiber of the present invention, and in each of FIGS. 1 and 2, the fiber of the present invention is included in the region surrounded by 4 lines.

FIG. 3 is a diagram illustrating one embodiment of the process for preparing fibers according to the present invention, in which the numbered elements are as follows:

1*a:* non-coagulating layer, 1*b:* coagulating layer, 2: spinneret, 3*a,* 3*b,* 3*c:* filaments, 4: take-out roller, 5: guide roller, 6: turning conveyor, 7: treating conveyor, 8: washing device, 9: drying device, 10: device for heat treatment under tension, 11: winding device, 12: cover belt.

FIG. 4(A) is a model diagram showing the cross-section of the fiber, and FIG. 4(B) shows the interference fringe observed in the lateral direction when the fiber of the present invention is examined by an interference microscope using polarized light vibrating in a direction perpendicular to the fiber axis, and the designated elements are as follows:

d: deviation of the interference fringe in the fiber at points S, D: distance between parallel interference fringes of the background, r: radius of the cross-section of the fiber, $r_o$: center of the cross-section of the fiber, $r_G$: periphery of the fiber, S: optinal point on the cross-section of the fiber, S′, S″: periphery of the fiber corresponding to S, t: thickness of the cross-section of the fiber measured along the direction of incident light at point S.

DESCRIPTION OF THE PREFERRED EMBODIMENTS

Reference will now be made in detail to the presently preferred embodiments of the invention, an example of which is illustrated in the accompanying drawings.

The fibers of the present invention have crystalline regions having a structure characterized in that the apparent crystallite size (ACS in Å) and the orientation angle (OA in degrees) are in the range satisfying conditions of the four formulae:

$$OA \geqq 0.10(ACS) + 4.8 \quad (5)$$

$$OA \geqq 0.40(ACS) - 19.8 \quad (6)$$

$$OA \leqq 0.05(ACS) + 13.3 \quad (7)$$

$$OA \leqq 3(ACS) - 146 \quad (8)$$

FIG. 1 has been prepared for illustrating this range intelligibly.

In FIG. 1, four lines (a), (b), (c), and (d) respectively correspond to the four formulae:

(a): $OA = 0.10(ACS) + 4.8$ (b): $OA = 0.40(ACS) - 19.8$ (c): $OA = 0.05(ACS) + 13.3$ (d): $OA = 3(ACS) - 146.$

The fibers of the present invention having such specific fine-structure in crystalline regions are distinct over known fibers, such as fibers disclosed in U.S. Pat. No. 3,869,429 and fibers marketed under the tradename "Kevlar" (fibers manufactured and sold by duPont; it is popularly said that they are PPTA fibers), in that the apparent crystallite size is relatively large. Moreover, the fibers of the present invention are distinct over fibers disclosed in U.S. Pat. No. 3,869,430 and fibers marketed under the tradename "Kevlar-49" (fibers manufactured and sold by duPont; it is popularly said that they are PPTA fibers), in that the degree of orientation of molecular chains in the crystalline region is relatively low. Furthermore, the fibers of the present invention are distinct over fibers prepared according to the process disclosed in the non-heat-treatment process in U.S. Pat. No. 4,016,236, in that the apparent crystallite size is relatively large and the orientation angle is relatively small. In connection with physical properties, the fibers of the present invention are characterized by a Young's modulus higher than 600 g/d, while the Young's modulus is at most 600 g/d in known fibers, such as those disclosed in U.S. Pat. No. 3,869,429 and the non-heat-treated PPTA fibers in U.S. Pat. No. 4,016,236.

The fibers of the present invention have a larger orientation angle (OA) than fibers as disclosed in U.S. Pat. No. 3,869,430, etc., and this relatively large orientation angle is closely related to the fact that in the manufacturing process, all the steps from washing to drying are carried out in the absence of tension and the heat treatment under tension is then conducted. Furthermore, it is quite surprising that although the fibers of the invention have such a large orientation angle (OA), i.e., a low degree of orientation of molecular chains in the crystalline region, they have a high Young's modulus comparable to that of fibers disclosed in U.S. Pat. No. 3,869,430.

In order for fibers to have such a high Young's modulus as exceeding 600 g/d and enhanced resistance to stress in the lateral direction or to friction while retaining high tenacity, it is one of the necessary conditions that the fibers have a structure defined by the above-mentioned four formulae in the crystalline regions.

More specifically, in fibers failing to satisfy the requirement of the formula:

$$OA \geqq 0.10(ACS) + 4.8, \quad (5)$$

the orientation angle (OA) is excessively small, that is, the orientation of the molecular chain is too advanced in the crystalline regions. In this case, both the tenacity and Young's modulus are at high levels, but the resistance to stress in the lateral direction or to friction is low. Accordingly, these fibers have a defect in that they are readily fibrillated when exposed to such external forces. From this viewpoint, it is preferred that the orientation angle be so large that the ratio of the apparent crystallite size (ACS) to the orientation angle (OA) is 5.4 Å/degree or less.

In fibers failing to satisfy the requirement of the formula:

$$OA \geqq 0.40(ACS) - 19.8, \quad (6)$$

the apparent crystallite size (ACS) is too large, and therefore, the tenacity is poor and, also, the resistance to stress in the lateral direction, or to friction, is degraded. From the viewpoint of the tenacity of fibers, it is preferred that the ACS value be 75 Å or less.

Furthermore, in fibers failing to satisfy the requirement of the formula:

$$OA \leqq 0.05(ACS) + 13.3, \quad (7)$$

the orientation angle (OA) is too large. In other words, the degree of orientation is too low in the molecular chains in the crystalline region. Accordingly, in these fibers, it is impossible to maintain the Young's modulus at a level exceeding about 600 g/d. Therefore, these fibers cannot be used where high resistance to deformation is required, for example as reinforcers for plastics or rubber belts.

Furthermore, in fibers failing to satisfy the requirement of the formula:

$$OA \leqq 3(ACS) - 146, \quad (8)$$

the apparent crystallite size (ACS) is too small and the crystallinity is low. These fibers are inferior to the fibers of the present invention in Young's modulus, and they are defective in that, when they are exposed to high temperatures, for example, about 200° C., dimensional shrinkage is caused. In order to eliminate this defect, it is preferred that the apparent crystallite size (ACS) should be at least 55 Å.

It is said that fibers manufactured on an industrial scale and now marketed under the tradename "Kevlar-49", by duPont, are PPTA fibers, and though the apparent crystallite size and orientation angle of the fibers vary to some extent among lots, it was found in products obtained by the inventors of the present invention that the apparent crystallite size is in the range of from 60 Å to 70 Å and the orientation angle is in the range of from 8° to 10.5°. It is considered that these commercial fibers are intended to be used for reinforcing plastics and the like. With the bending fatigue test used in the present invention for determining the resistance to stress in the lateral direction or to friction, which will be described in detail hereinafter, it was confirmed that the fatigue-resistant life of the fibers of the present invention was about twice that of fibers of "Kevlar-49". From this experimental result, it will readily be understood that the fibers of the present invention are highly improved over the conventional fibers.

The reason the fibers of the present invention have such excellent physical properties cannot be sufficiently explained only by the orientation angle (OA) and the apparent crystallite size (ACS), which are parameters reflecting the fine-structure of crystalline regions. In order to clarify the above reason sufficiently and completely, not only these two parameters, but also other parameters reflecting the fine-structure of the polymer chains in amorphous regions should be taken into account.

As parameters characterizing the fibers of the present invention can be mentioned the X-ray diffraction intensity ratio (RIX) as the generic parameter concerning the size of crystalline regions and the orientation of the molecular chains, the specific central refractive index (Nvo) of the fibers by polarized light vibrating in the direction perpendicular to the fiber axis, which is connected with the X-ray diffraction intensity ratio, and two specific tangential refractive indexes (TRIv and TRIp). More specifically, the fibers of the present invention are characterized in that the refractive index (Nvo) in the central portion of the fiber by polarized light vibrating in the direction perpendicular to the fiber axis and the X-ray diffraction intensity ratio (RIX) as the parameter of the crystalline region satisfy conditions represented by the formulae:

$$Nvo \geqq -0.08(RIX) + 1.670 \quad (1)$$

$$Nvo \leqq 1.640 \quad (2)$$

$$RIX \geqq 0.85 \quad (3)$$

$$RIX \leqq 1.10 \quad (4).$$

FIG. 2 is presented for illustrating these conditions intelligibly. In FIG. 2, lines (e), (f), (g), and (h) respectively correspond to the four formulae:

(e): $Nvo = -0.08(RIX) + 1.670$ (f): $Nvo = 1.640$ (g): $RIX = 0.85$ (h): $RIX = 1.10$

It is very difficult to prepare fibers satisfying the condition of the formula (1) from the known techniques. The reason for this is that, although the Nvo value is considered to depend on the degrees of orientation of polymer chains (especially molecular chain axes) in crystalline and amorphous regions, and the degrees of radial orientation of specific axes perpendicular to the molecular chain axis (especially the crystallographic axis b), in PPTA fibers, the Nvo value is considered to be a certain inherent value determined by the chemical structure and it is considered that the absolute value of Nvo will not be changed to any significant extent. In fact, in fibers disclosed in U.S. Pat. No. 3,869,430, the molecular chains in crystalline regions are oriented to the very utmost extent in the direction of the fiber axis. In this case, theoretically, the Nvo value should be in the range of from 1.62 (the crystallographic axis b is random in the radial direction) to 1.51 (the crystallographic axis b is completely oriented in the radial direction). Incidentally, $N\alpha = 1.5138$, $N\beta = 1.733$ and $N\gamma = 2.04$ have been adopted for the illustration as theoretical values of the main refractive index (see Yabuki et al., Sen-i Gakkai Shi, 32, T55 (1976)); it should be noted here that the actual measurement of Np described below, made by the inventors of the present invention, indicated that $N\gamma$ was 2.07 or larger). In commercially available PPTA fibers having a Young's modulus exceeding about 600 g/d (Kevlar-49) and fibers prepared according to the process disclosed in U.S. Pat. No. 3,869,430, the Nvo value is always less than 1.585, that is, the fiber has excessively large degree of orientation of b axis in the radial direction.

Fibers satisfying the condition of the formula (1) are realized by the fiber preparation process in which the washing and drying steps are conducted in the absence of tension and the heat treatment is then conducted under tension, and fulfillment of this condition is closely related to the characteristic that resistance to stress in the lateral direction is excellent. This preferred characteristic is prominent when the Nvo value is at least 1.600, and this characteristic is especially conspicuous when the Nvo value is at least 1.605.

It is construed that the fibers of the present invention characterized by the conditions of the formulae (1) through (4) have a specific fine-structure in which the degree of orientation in the radial direction is relatively low in either the crystallographic axis b or the axis corresponding to the crystallographic axis b in the amorphous region; the amorphous region consists of molecular chains which are stable with respect to potential energy; and the crystalline region has a relatively high degree of crystallinity and a relatively high perfectness. It is considered that such characteristics of molecular chains in the amorphous region contribute to the realization of an excellent resistance to stress in the lateral direction.

When the condition of the formula (2), that is, $Nvo \leqq 1.640$, is not satisfied, the Young's modulus of the fibers is drastically reduced, and a high Young's modulus, one of the characteristics of the fibers of the present invention, cannot be attained. Generally, as the Nvo value is increased, both the tenacity and Young's modulus tend to decrease, and this tendency is enhanced with the line of $Nvo = 1.640$ being the critical boundary. The preferred Young's modulus is realized if the condition of $Nvo \leqq 1.630$ is satisfied.

Fibers satisfying the condition of the formula (3) are characterized by a relatively high degree of crystallinity and a high perfectness of the crystal, and fulfillment of this condition is related to a high Young's modulus and an excellent dimensional stability at high temperatures. it is preferred that the RIX value be at least 0.90. Fibers satisfying the conditions of $RIX \geqq 0.85$, which have a relatively high degree of crystallinity and high perfectness of the crystal, can be conveniently prepared by the preparation process in which the heat treatment is carried out under tension at a specific temperature subsequently to the drying step.

Fibers failing to satisfy the condition of formula (4), that is, $RIX \leqq 1.10$, have an excessively high degree of crystallinity and perfectness of the crystal and a low tenacity. It is preferred that the RIX value be 1.05 or less.

Theoretically the physical significance of RIX is not completely clear, but the relation of RIX to physical properties (particularly Young's modulus and fatigue resistance) is closer than the relation of ACS to physical properties. The inventors of the present invention understand that RIX is a parameter reflecting the anisotropy of the crystal growth direction, the anisotropy of the distribution density of defects, the conformation of the molecular chain in the crystalline region and the variation of the packing state of the molecular chain (for example, crystal structures I and II proposed by Takayanagi et al., Polymer Preprints, Japan 26 (1977)). The RIX value is ordinarily increased by the heat treatment, and it is considered that this increase of the RIX value is due to the fact the RIX value reflects the above-mentioned complex changes of the structure.

The fibers of the present invention can be observed by an interference microscope utilizing polarized light vibrating in the direction parallel to the fiber axis (in this case refractive index is referred to as Np), by using as a medium a mixture comprising 8 parts by weight of yellow phosphorus, 1 part by weight of methylene iodide and 1 part by weight of sulfur, according to the method adopted for determination of Nvo and TRIv, which will be described hereinafter. It is interpreted that the thus measured Np value is a parameter reflecting the orientation of polymer molecular chains in both the crystalline region and the amorphous region. It was found that the Np value of the fibers of the present invention is unique. More specifically, the Npo value, that is, the Np value in the center of the fiber, and TRIp, the tangent of the Np value in the cross-sectional direction of the fiber, are in specific ranges. Concretely, in the fibers of the present invention, the Npo value is at least 2.11, preferably at least 2.12. In contrast, in known fibers and fibers prepared according to known processes, the Npo value is at most 2.10. The reason for this is considered to be that in the fibers of the present invention, the degree of orientation of the molecular chain in the central portion of the fiber is higher than in commercially available PPTA fibers, such as Kevlar and Kevlar-49. This is one of the characteristics of the fibers of the present invention. As another parameter of the fine-structure, by which the fibers of the present invention can be distinguished from known, so-called high Young's modulus PPTA fibers (such as fibers disclosed in U.S. Pat. No. 3,869,430 and Kevlar-49 fibers), there can be mentioned TRIp. More specifically, it has been confirmed that the fibers of the present invention have a TRIp value of from $-0.020$ to $+0.020$, while known, so-called high Young's modulus fibers have a TRIp value of at least $+0.030$. From these TRIp values, it is inferred that in the fibers of the present invention, the degree of orientation of the polymer molecular chains in the central portion of the fiber is relatively high. It was found that this characteristic of the fibers of the present invention with respect to fine-structure is closely related to an excellent resistance to stress in the lateral direction in the fibers of the present invention. The resistance to stress in the lateral direction is further improved when the TRIp value is in the range of from $-0.015$ to $+0.010$.

If the direction of the axis of the molecular chain is completely in agreement with the direction of the fiber axis, the degree of orientation of the crystallographic axis b and the axis corresponding to the crystallographic axis b in the amorphous region with respect to the radial direction may be represented by the tangent (TRIv) of the Nv value along the radial direction. In U.S. Pat. No. 3,869,430, such orientation in the radial direction is expressed as a parameter identified as the lateral birefringence, and it is disclosed that fibers having a high lateral birefringence, that is, a high degree of orientation in the radial direction, have preferred physical properties. However, adoption of the parameter of lateral birefringence involves a problem, because a troublesome operation of cutting the fiber is necessary for determining the lateral birefringence.

The TRIv value used by the inventors of the present invention can represent the degree of radial orientation with high precision. As a result of detailed examination, it was found that the TRIv value, that is, the degree of radial orientation, has only a remote correlation to physical properties (such as tenacity and Young's modulus) of the fiber and that fibers having too large a TRIv value are inferior in resistance to stress in the lateral direction or to friction. More specifically, it was found that the TRIv value should be no more than 1.10. It is preferred that the TRIv value be no more than 0.09.

In preparing fibers from an anisotropic dope, it is not preferred to advance coagulation while subjecting fibers to substantial elongation, because the aggregation structure or higher order fine-structure in the fiber tends to change to a disordered structure. As such coagulation method, there can be mentioned a method in which a spinneret is immersed in a coagulating layer and a dope is spun from this spinneret. When fibers obtained by this method are observed by an interference microscope, it is seen that the aggregation structure or higher order fine-structure is disordered in the fibers. Furthermore, when these fibers are observed by a polarizing microscope, it is seen that grains having a size of about 1 μm are formed in the interior of the fiber and it is interpreted that this structure is comprised of a continuity of grains of the liquid crystal. From the report of Takayanagi et al. (Polymer Preprints, Japan 26 (1977)), it is apparent that a polymer having a very high polarity, such as the PPTA of the present invention, is coagulated with a specific crystal orientation to the interface. Therefore, since PPTA fibers retaining the inherent higher order fine-structure in the non-disordered state show an orientation of b axis to the fiber surface, that is, the radial orientation of a given crystal axis, when an immersing liquid medium having a refractive index substantially equal to that of the fibers is adopted and the fibers are observed by an interference microscope, a special interference fringe, such as the one shown in FIG. 4, can be seen. Such interference fringe is sufficiently manifested if destruction by elongation of the coagulated surface or opacification by heterogeneous coagulation is not caused at the coagulating step or after the coagulation, and manifestation of the interference fringe is not substantially influenced by the polymer concentration in the dope or like factors. As means capable of producing such preferred coagulation, there can be mentioned a spinning method in which a spinneret is separated from a coagulating layer and the tension for orientation is concentrated to a dope stream which is still in the non-coagulated state and is passing through a non-coagulating layer. In contrast, when there is adopted the above-mentioned method in which the dope is spun from a spinneret immersed in a coagulating layer and tension is applied for elongation at the coagulating step, opacification is caused in the spun fibers or no continuous interference fringe can be observed. This apparently indicates the presence of a heterogeneous aggregation structure. Fibers having such heterogenous aggregation structure are poor in both tenacity and elongation.

TRIv is a parameter for quantitative determination of the pattern of the interference fringe observed by an interference microscope. In fibers having a disturbed aggregation structure, no clear interference fringe can be measured. In contrast, the fibers of the present invention are characterized by a TRIv value of from 0.06 to 0.10.

The lower limit of the TRIv value is decided depending on the Young's modulus of fibers and the dimensional stability at high temperatures. It is preferred that the TRIv value be at least 0.065.

In the fibers of the present invention, it is preferred that the dynamic mechanical loss tangent (tan δ), as determined at a temperature of 30° C. and a relative humidity of 60%, be in the range of from 0.001 to 0.030. In fibers having a dynamic mechanical loss tangent larger than 0.030, the ratio of the amorphous region is excessively high and the dimensional stability is poor or the moisture absorbing property becomes conspicuous. Accordingly, in some application fields, disadvantages are caused by the use of such fibers. In fibers having a dynamic mechanical loss tangent (tan δ) smaller than 0.001, the degree of crystallinity is too high and mechanical properties of the fibers are degraded. The tan δ value measured at the above-mentioned temperature varies depending on the amounts of water and solvent incorporated. Ordinarily, this value is increased by an increase in the amount of impurities and solvent incorporated.

If the size of the monofilament constituting the fiber of the present invention is too large, there is observed a reduction of the tenacity or the like, which is considered to be due to flow orientation or coagulation speed at the spinning step. Accordingly, too large a size is not preferred and the fineness of several denier or less is ordinarily adopted. Generally, it is preferred that the monofilament denier be no more than about 3.0. The lower limit is not particularly critical, but a minimum monofilament denier ordinarily attainable industrially, that is, a monofilament denier of about 0.1, may be adopted as the lower limit.

By "a polymer consisting essentially of poly-p-phenylene-terephthalamide (hereinafter referred to as "PPTA")", which constitutes the fiber of the present invention, a polymer derived from terephthalic acid and p-phenylene diamine, each having an industrial purity, is meant. Preferably, this polymer is prepared according to a so-called low-temperature solution polymerization method, in which a polymer is formed from terephthaloyl chloride and p-phenylene diamine in an N-alkyl substituted carbonamide type solvent or a mixture of two or more of such solvents, or in a mixture of such solvent with lithium chloride or calcium chloride (see, for example, Japanese Patent Publication No. 14399/60).

In preparation of fibers of the present invention, in order to realize a high tenacity or high Young's modulus, it is ordinarily preferred to use a polymer having a high degree of polymerization. More specifically, it is preferred to use a polymer having an inherent viscosity of at least 5.0 dl/g, particularly at least 5.5 dl/g, as measured under conditions described hereinafter. Incidentally, the degree of polymerization of the polymer is sometimes reduced in the process starting with the step of dissolving the polymer in concentrated sulfuric acid and ending with the spinning step. Accordingly, it is desired to use a polymer having an inherent viscosity slightly higher than the desired inherent viscosity of the fiber. More specifically, it is preferred to use a polymer having an inherent viscosity higher by 0.1 to 0.5 dl/g than the desired inherent viscosity of the fiber, although the value differs to some extent depending on the temperature control and residence time at the dissolving step and subsequent step. The upper limit of the inherent viscosity is not particularly critical. However, from the viewpoint of the viscosity of the spinning dope, it is preferred that the inherent viscosity of the polymer be less than about 10 dl/g.

The process for the preparation of the fibers of the present invention will now be described.

At first, the above-mentioned polymer is dissolved in concentrated sulfuric acid and the resulting spinning dope is passed through a non-coagulating layer, and then, through a coagulating layer to coagulate the spun dope in the fibrous form.

From the viewpoints of the dissolving power and the price, concentrated sulfuric acid is preferred as the polymer-dissolving solvent. In order to dissolve PPTA having the above-mentioned high inherent viscosity at a high concentration, concentrated sulfuric acid having a concentration of at least 98% by weight is employed. Use of so-called fuming sulfuric acid containing free $SO_3$ is not preferred because $SO_3$ rather reduces the dissolving power and there is a possibility of sulfonation of the polymer by $SO_3$. The upper limit of the concentration of sulfuric acid is ordinarily 100% by weight.

The concentration of the polymer to be contained in the spinning dope is not particularly critical. For economical reasons and to maintain good mechanical properties, especially a high tensile strength, in the resulting fibers, it is preferred that the polymer concentration in the spinning dope be at least 12% by weight, particularly at least 14% by weight. The upper limit of the polymer concentration is not particularly critical. However, at too high a polymer concentration, stable spinning becomes impossible. Accordingly, the polymer concentration is ordinarily adjusted to about 20% by weight or lower. In order to improve the resistance to stress in the lateral direction according to the preferred embodiment of the present invention, it is preferred that the polymer concentration be adjusted to 19% by weight or lower.

The dope that is used in the present invention should be anisotropic, at least at a temperature at which it is extruded from the spinneret. This condition is indispensable for realizing preferred mechanical properties in the resulting fibers. Whether the dope is anisotropic or not can be determined according to, for example, the optical method disclosed in U.S. Pat. No. 3,819,547.

When the spinning dope is prepared and used, since the dope is sometimes solidified at a temperature approximating room temperature if the polymer concentration is maintained in the above-mentioned range of from 12 to 20% by weight, the dope is handled at a temperature ranging from room temperature to about 80° C. However, to avoid decomposition of the polymer as much as possible, a temperature as low as possible should be chosen.

The spinning dope is first extruded into a non-coagulating layer from the spinneret and then introduced into a coagulating layer. A gas, such as air or nitrogen, or a non-coagulating liquid, such as toluene or heptane, is used for the non-coagulating layer. From the viewpoint of ease of carrying out the spinning operation and from the economical viewpoint, the use of a gas is preferred and air is most preferred. Incidentally, a vapor of a coagulating liquid (for example, water or methanol) may be contained at the saturated or unsaturated state in the gas.

The thickness of the non-coagulating layer is ordinarily about 0.1 to about 10 cm, and preferably 0.3 to 2 cm. When the thickness of the non-coagulating layer is too large, the spinning dope included in the scope of the present invention shows a so-called thixotropic viscosity characteristic. More specifically, the apparent viscosity is reduced with an increase of the deformation velocity, and therefore, the resulting fibers are not uniform in the size of cross-section resulting in a reduction of tensile strength and elongation. If the thickness of the non-coagulating layer is too small, the obtained results are not substantially different from the results obtained when the spinning face of the spinneret is immersed in a coagulating bath. When the process of the present invention in which a non-coagulating layer is interposed between the spinning surface of the spinneret and the coagulating layer is adopted, there can be attained an advantage that, since take-up drafting (stretching) is imposed on a stream of the dope in the non-coagulating layer and stretching is not or hardly imposed on fibers being solidified or already solidified in the coagulating layer, destruction or cracking of the fine-structure or further micro-cracking is not caused. This characteristic is related to the fact that the fibers of the present invention are not opacified or they have a specific tangential refractive index (TRIv). The fibers of the present invention can be distinguished by such characteristic of the fine-structure from fibers obtained by the wet spinning process, in which the spinning dope is extruded from the spinning surface of the spinneret immersed in the coagulating layer.

Another advantage of the spinning process of the present invention is that, when a gas is selected for the non-coagulating layer, the temperature of the coagulating layer can be freely set independently from the temperature of the dope at the spinneret. Since the dope that is used in the present invention is sometimes solidified at a temperature approximating room temperature, it is often necessary to use a temperature higher than room temperature as the dope temperature. In this case, the coagulating layer can be maintained at room temperature or a lower temperature independently from the dope temperature. This advantage is important and significant from an industrial viewpoint.

Still another advantage of the spinning process of the present invention is that the draft (the ratio of the take-up velocity of coagulated fibers to the velocity of extrusion of the dope from the spinneret) can be increased over the draft attainable in the conventional wet spinning process using the spinneret immersed in the coagulating layer. By virtue of this advantage, it is possible to prepare fibers having highly improved tenacity and Young's modulus.

The configuration and size of the spinneret to be used for spinning are not particularly critical, but use of excessively small spinning holes should be avoided so as to prevent clogging and use of very large spinning holes should be avoided from the viewpoints of the extrusion linear velocity and shearing orientation. Ordinarily, the diameter of the spinning holes is chosen in the range of from 0.06 to 0.09 mm according to the spinning velocity and the intended monofilament denier.

The kind of coagulating layer is not particularly critical, but a coagulating layer of water or sulfuric acid having a concentration lower than 50% by weight (aqueous solution of sulfuric acid) is preferred. The bath temperature of the coagulating layer is also not particularly critical. However, in order to prevent corrosion of the equipment material by dilute sulfuric acid, the bath temperature is preferably in the range of from room temperature to a temperature approximating the freezing point of the coagulating layer.

The coagulated fibers are then deposited on a net conveyor and subjected to water washing (removal of sulfuric acid) and drying. FIG. 3 illustrates one preferred embodiment of water washing and drying on the net conveyor. Referring to FIG. 3, an optically anisotropic dope of PPTA is extruded from a spinneret 2 into a non-coagulating layer 1*a* and then into a coagulating layer 1*b*. The solidified filament 3*a* is taken out from the coagulating layer 1*b* by a take-out roller 4 and is then caused to fall onto a turning conveyor 6 by a guiding roller 5. The guiding roller 5 has a cage-like appearance and is composed of a plurality of rods which constitute the filament-guiding periphery. Filaments 3*b* are piled on the conveyor 6 in the loosened state to form an endless narrow fleece, and they are transferred onto a treating conveyor 7 while being turned over. The treating conveyor 7 is removed continuously or intermittently by a suitable driving device at a velocity substantially equal to that of the turning conveyor 6. The fleece of piled loose filaments in the tension-free state is delivered to a washing device 8 and then to a drying device 9 by the treating conveyor 7. The filaments 3*c* are taken out from the treating conveyor 7, passed through a device 10 for the heat treatment under tension and wound on a bobbin by a winding device 11. A cover belt 12 is disposed to prevent the filaments 3*b* piled in the tension-free state from being disturbed at the washing and drying steps.

It is one of the indispensable requirements for realizing the fibers of the present invention having a specific fine-structure as described above that no substantial tension should be imposed on the fibers in the lengthwise direction throughout the water washing and drying steps. Accordingly, it is necessary to carefully handle the filaments from the coagulating layer, to carefully deposit them on the net conveyor, and to use special devices so that the above-mentioned requirements are satisfied effectively.

Also at the step of taking out the filaments from the coagulating layer, it is important that no substantial tension should be imposed on the filaments. Accordingly, it is not preferred to dispose a direction-changing guide or the like in the coagulating layer. Therefore, it is preferred to adopt a method in which a funnel type spinning bath is used, as customarily used for spinning of cuprammonium rayon, and the fibers are taken out from the bath by the funnel as illustrated in FIG. 1 of Japanese Patent Publication No. 22204/69. A double-funnel type spinning bath, as disclosed in Japanese Patent Application Laid-Open Specification No. 144911/78, is especially preferred.

Also, when the filaments taken out from the coagulating layer are deposited on the net conveyor, stretching or treatment under tension should not be performed, and it is necessary to minimize the direction-changing angle so that the tension imposed on the filaments by the resistance to take-out of the filaments from the coagulating layer or by the friction with guides and the like is maintained below about 0.2 g/d. Furthermore, careful attention should be paid to the material or surface roughness of the guides.

When the filaments on the net conveyor are washed with water under no substantial tension to remove sulfuric acid therefrom, neutralization with aqueous alkali may optionally be performed prior to or during water washing according to need. However, application of an epoxy compound or the like to the surfaces of the filaments after water washing is not preferred, because variation of the fine-structure, and in turn, variation of physical properties, are readily caused in the fibers by this treatment.

The washed filaments are then dried while they are deposited on the net conveyor. The drying temperature is not particularly critical, as long as drying is conducted under no substantial tension. From the viewpoints of energy efficiency and the drying capacity, the drying treatment is ordinarily carried out at about 50° to about 300° C., preferably 80° to 200° C. The drying time is ordinarily in the range of from about 30 seconds to about 60 minutes. To impart to fibers an appropriate crystallinity, one of the characteristics of the present invention, according to one of the preferred embodiments of the present invention, the drying treatment is carried out under such conditions that the value of (drying temperature in °C.)×(drying time in seconds)$^{0.08}$ is in the range of about 150 to about 300.

To realize an appropriate crystallinity and a distortion-free fine-structure of the amorphous region and obtain fibers exerting the characteristics of the present invention prominently, it is preferable to treat the filaments in the state deposited on the net conveyor in the absence of tension with saturated steam maintained at a temperature of at least 100° C. after washing and before or after drying.

The dried filaments are released from the tension-free state and subjected to heat treatment under tension as they are, or after they have been wound. A method in which drying in the absence of substantial tension on the net conveyor is not carried out and the heat treatment under tension is conducted just after the washing treatment is not preferred, because excessive orientation is readily caused in polymer chains.

The heat treatment under tension should be carried out at a temperature of 200° to 500° C. At a temperature lower than 200° C., the treatment should be conducted for a very long time to obtain a sufficient heat treatment effect. To shorten the treatment time, it is preferred to elevate the heating temperature, but at a temperature higher than 500° C., the loss of heat energy is great and it is very difficult to suppress the advancement of excessive crystallization in fibers. Accordingly, the upper limit of the heating temperature is set at 500° C. A preferred heating temperature is in the range of from 250° C. to 400° C.

Generally, the heat treatment under tension is conducted for 0.5 to 60 seconds. In preparing fibers of the present invention, it is preferred to set the heating time correlatively with the heating temperature. More specifically, to prepare fibers having a specific fine-structure defined in the present invention, it is preferred that the value of (heating temperature in °C.)×(heating time in seconds)$^{0.08}$ be in the range of from 250 to 550 (°C.×sec.$^{0.08}$). If this value is smaller than 250 (°C.×sec.$^{0.08}$), thermal setting of the polymer chain is insufficient, and if the fibers are allowed to stand in an atmosphere maintained at, for example, about 200° C., shrinkage of the dimensions is caused to occur; or, if the fibers are kept in such atmosphere under slight tension, changes of physical properties (for example, reduction of elongation) are readily caused. And, when the above-mentioned value is smaller than 250 (°C.×sec.$^{0.08}$) the fibers are almost always lowly crystalline fibers having a small RIX or ACS value. In contrast, when the above-mentioned value exceeds 550 (°C.×sec.$^{0.08}$) at the heat treatment under tension, reduction of the degree of polymerization takes place or excessively crystalline fibers are readily formed and the tenacity is reduced in such fibers. It is especially preferred that the heat treatment be carried out so that the above-mentioned value is 280 to 500 (°C.×sec.$^{0.08}$).

The degree of tension at the heat treatment under tension is not particularly critical, but in order to facilitate this heat treatment, a tension of 1 to 15 g/d is preferably adopted. Generally, the tension stress at the heat treatment is closely related to elevation of the degree of orientation of polymer chains in fibers. In the present invention, since the heat treatment under tension is carried out after fibers have been washed and dried in the absence of substantial tension, the fibers of the present invention have unique fine-structure not possessed by conventional so-called high Young's modulus fibers, that is, the fine-structure characterized in that the degree of orientation of polymer chains in the central portion of the fiber is relatively high and that in the peripheral portion of the fiber is relatively low. By virtue of this specific fine-structure, the resistance to stress in the lateral direction is highly improved in the fibers of the present invention. Incidentally, a process in which heat treatment is carried out in the absence of tension is disclosed in U.S. Pat. No. 4,016,236. In this process, however, the orientation of polymer chains is insufficient, and the resulting fibers fail to have a sufficiently high Young's modulus.

The method for performing the heat treatment under tension is not particularly critical. For example, there may be adopted a method in which fibers are passed through a high temperature gas, such as heated air, heated nitrogen, combustion gas, or superheated steam, while they are stretched between rollers as illustrated in FIG. 3; or a method in which fibers are heated by a hot plate or far-infrared ray generator. To prevent reduction of the degree of polymerization at the heat treatment under tension, it is preferred that the treatment be carried out in an inert gas such as nitrogen or argon. The heat treatment under tension is ordinarily conducted in one stage, but the treatment may be conducted in two or more stages by using the same or different temperatures.

If the heat treatment under tension is carried out after the dried fibers have been wound and twisted, the tension imposed on individual filaments is uniform and better results are obtained.

The heat-treated fibers are subjected to various post-treatments, such as application of a finishing oiling agent, adjustment of the moisture content, coloration for discrimination and interlacing treatment, according to need, and then they are wound. In practicing the process of the present invention, no particular limitation is set for such post-treatment or winding operation.

The fibers of the present invention are prepared under specific conditions as described hereinbefore, and they are characterized by a very high Young's modulus, high tenacity, and high resistance to stress in the lateral direction or to friction. Therefore, the fibers of the present invention are very valuable as reinforcers for plastics and rubbers. Such superior physical properties of the fibers of the present invention are closely related to the specific fine-structure of the fibers, which specific fine-structure cannot be realized by any known conventional processes.

The fibers of the present invention are ordinarily used in the form of multifilaments when they are used for reinforcing plastics or rubbers. Since fields of application of the fibers of the present invention are not limited to this use, they may be in the form of roving yarns, staple fibers, chopped strands, and the like.

The fibers of the present invention can be used especially effectively for reinforcing plastics and rubbers, particularly as reinforcing cords for rubber belts, such as V-belts, flat belts, and toothed belts. In this case, the highly improved resistance to stress in the lateral direction, that is, one characteristic of the present invention, can be exerted most effectively. The fibers of the present invention retain excellent properties possessed by conventional PPTA fibers, such as high tenacity, good dimensional stability, good heat resistance, and high flame retardancy, and the fibers of the present invention can be applied to various uses to which conventional PPTA fibers have been applied.

It was found that another characteristic of the fibers of the present invention is that the alkali resistance is very superior to that of conventional PPTA fibers (such as Kevlar and Kevlar-49). This characteristic is exerted very prominently when the fibers are used for reinforcing concrete structures.

Methods for determining the main parameters to be used for specifying the fine-structure of fibers and evaluating physical properties of fibers will now be described.

Method of Measurement of Inherent Viscosity

The inherent viscosity ($\eta$inh) is defined by the equation: $\eta inh = (\ln \cdot \eta rel)/C$ and is measured, at 30° C., with respect to a solution formed by dissolving the polymer or fiber, at a concentration C of 0.5 g/dl, in concentrated sulfuric acid having a concentration of 98.5%, by weight, according to customary procedures.

Method of Measurement of Tenacity and Elongation of Fibers

The tensile strength, elongation, and Young's modulus of the filaments are measured according to customary procedures, as disclosed in U.S. Pat. No. 3,869,429, unless otherwise indicated.

Method of Measurement of Resistance to Bending Fatigue in Fibers

The method for measuring the bending strength of fibers according to a modification of the test method for determining the folding endurance of paper, described hereinafter, is adopted as the method for evaluating the resistance of fibers to stress in the lateral direction or to friction.

The measurement is carried out according to the method of JIS P-8115 by using fibers instead of paper, and disposing a thin rubber sheet between the fiber and the holding portion so as to hold the fiber in a good condition. Other conditions are the same as specified in JIS P-8115. More specifically, the fiber is repeatedly bent under conditions of a tension of 1 kg, a folding angle of 135° on each side, a fiber length of 110 mm, and a folding frequency of 175 times per minute. This repeated bending operation is conducted until the fiber is broken. The repetition frequency of the bending operation conducted until the fiber is broken is defined as the fatigue-resistant life. The measurement is conducted 5 times and an average value is calculated.

Method of Measurement of Central Refractive Indexes (Nvo and Npo) and Tangential Refractive Indexes (TRIv and TRIp)

The specific molecular orientation in the fibers of the present invention will be apparent from the values of the central refractive indexes (Nvo and Npo) and tangential refractive indexes (TRIv and TRIp) obtained by using a transmission quantitative type interference microscope. Such specific molecular orientation leads to an excellent resistance to bending fatigue.

According to the interference fringe method using a transmission quantitative type interference microscope (for example, an interference microscope, "Interphako", manufactured by Carl-Zeiss Yena Co., East Germany), the distribution of the average refractive index, observed from the side face of the fiber, can be determined. This method can be applied to fibers having a circular cross-section.

The refractive index of fibers is characterized by a refractive index (Np) to polarized light vibrating in the direction parallel to the fiber axis and a refractive index (Nv) to polarized light vibrating in the direction perpendicular to the fiber axis. Refractive indexes (Np and Nv) obtained by using green rays (wavelength $\lambda=546$ m$\mu$) are employed. The measurement of Nv and determination of Nvo and TRIv will now be described in detail. Of course, the measurement of Np and the determination of Npo and TRIp can be performed according to similar procedures.

The fiber to be tested is immersed in a medium inert to fibers having a refractive index (Nr) giving a deviation of the interference fringe in the range of 0.2 to 2.0 times the wavelength by using optically flat slide glass and cover glass. The refractive index (Nr) of the medium is a value measured at 20° C. by an Abbe refractometer using green rays (wavelength $\lambda=546$ m$\mu$). Several filaments are immersed in this medium so that the filaments are not in contact with one another. The fiber should be disposed so that the fiber axis is perpendicular to the optical axis of the interference microscope and the interference fringe. The pattern of the interference fringe is photographed and enlarged at 1500 to 2000 magnifications for analysis.

Referring to FIG. 4, the optical path difference R is represented by the formula:

$$R=(d/D)\lambda=(Nv-Nr)t$$

wherein Nr stands for the refractive index of the medium, Nv is the average refractive index between filaments S'-S'', t stands for the thickness between the filaments S'-S'', $\lambda$ represents the wavelength of the rays used, D stands for the distance (corresponding to $1\lambda$) between parallel interference fringes of the background and d stands for a deviation of the interference fringe by the fiber.

From optical path differences at respective positions in the range of the center $r_o$ of the fiber to the periphery $r_G$ of the fiber, the distribution of the average refractive index (Nv) of the fiber at the respective positions can be determined.

The thickness t can be calculated based on the supposition that the fiber obtained has a circular cross-section. However, it is believed that sometimes, owing to changes of manufacturing conditions or accidents after the preparation, fibers have a non-circular cross-section. Accordingly, it is preferred that the measurement be conducted on a portion where the deviation of the interference fringe is symmetric with respect to the fiber axis. The measurement is performed in the range of from the center ($r_o$) of the fiber to the position of 0.95 r from $r_o$, at intervals of 0.05 r, in which r represents the radius of the fiber, and thus, the average refractive index can be determined at each position. The central refractive index by polarized light vibrating in the direction perpendicular to the fiber axis is the value of the refractive index measured at the center of the fiber ($r_o$). The tangent of the refractive index TRIv by polarized light vibrating in the direction perpendicular to the fiber axis is represented by the equation:

$$TRIv=(Nv_{0.5}-Nvo)/0.5$$

wherein TRIv represents the tangent of the refractive index by polarized light vibrating in the direction perpendicular to the fiber axis, Nvo stands for the central refractive index and $Nv_{0.5}$ stands for the average refractive index at the position corresponding to 0.5 r from center of the fiber ($r_o$).

When the Np value is determined by using polarized light vibration in a direction parallel to the fiber axis, the Npo value is given by the refractive index value measured at the center of the fiber ($r_o$) and the TRIp value can be calculated according to the formula:

$$TRIp=(Np_{0.5}-Npo)/0.5$$

In determination of the tangential refractive index and central refractive index, the measurement is conducted on at least 3 filaments, preferably 5 to 10 filaments, and average values are calculated.

Results of the measurement of the Npo and TRIp values made on samples of fibers obtained in Examples 2 and 3, and Comparative Examples 4 and 5, are shown below.

| Sample | Npo | TRIp |
|---|---|---|
| Example 2-1 | 2.121 | −0.006 |
| Example 2-2 | 2.117 | −0.002 |
| Example 2-3 | 2.125 | −0.005 |
| Example 2-4 | 2.132 | −0.012 |
| Example 2-5 | 2.127 | +0.001 |
| Comparative Example 4 | 2.108 | +0.025 |
| Comparative Example 5 | 2.095 | +0.043 |
| Example 3-1 | 2.110 | +0.010 |
| Example 3-2 | 2.112 | +0.005 |
| Example 3-3 | 2.128 | −0.015 |
| Example 3-4 | 2.113 | +0.004 |

Method of Measurement of Orientation Angle (OA)

The orientation angle (OA) of the fiber is measured by using an X-ray generator (for example RU-200PL manufactured by Rigaku Denki), a fiber measuring device (FS-3 manufactured by Rigaku Denki), a goniometer (SG-9R manufactured by Rigaku Denki) and a scintillation counter. CuK$\alpha$($\lambda=1.5418$ Å) monochromatized by a nickel filter is used for the measurement.

Generally, the fibers of the present invention are characterized in that two major reflections appear on the equatorial line in the range of from 19° to 24° of $2\theta$. The reflection having a larger $2\theta$ value is used for the measurement of the orientation angle. The $2\theta$ value of the reflection used is determined from the curve of the diffraction intensity in the equatorial direction.

The X-ray generator is operated at 40 KV and 90 mA. The fiber sample is attached to the fiber measuring device so that monofilaments are parallel to one another. Preferably, the sample thickness is adjusted to about 0.5 mm. The goniometer is set at the $2\theta$ value determined by the preliminary test. The X-ray beam is applied in the direction vertical to the fiber axis of the filaments arranged in parallel to one another (vertical beam transmission method). Scanning is conducted in the range of from $-30°$ to $+30°$ in the azimuthal direction and the diffraction intensity is recorded by the scintillation counter. Furthermore, the diffraction intensity at $-180°$ and the diffraction intensity at $+180°$ are recorded. At this measurement, the scanning speed is 4°/min, the chart speed is 1.0 cm/min, the time constant is 2 or 5 seconds, the collimeter is characterized by 1 mm $\phi$, and the receiving slit angle is 1° in either the longitudinal direction or the lateral direction.

The orientation angle is determined from the obtained diffraction intensity curve according to the following procedures.

An average value of the diffraction intensity values obtained at $\pm 180°$ is evaluated and a horizontal line is drawn to pass through the point of the average value. A perpendicular line is drawn to the base line from the peak, and the mid-point of the perpendicular line is determined and a horizontal line passing through the mid-point is drawn. The distance between intersecting points of this horizontal line and the diffraction intensity curve is measured and the measured value is converted to an angle in degrees. This half value width of angle is defined as the orientation angle (OA).

Method of Measurement of Apparent Crystallite Size (ACS) and Diffraction Intensity Ratio (RIX)

ACS and RIX can be measured by determining the curve of the diffraction intensity in the equatorial direction by the reflection method.

The measurement is carried out by using an X-ray generator (RU-200PL manufactured by Rigaku Denki), a goniometer (SG-9R manufactured by Rigaku Denki) and a scintillation counter. CuK$\alpha$($\lambda$=1.5418 Å) monochromatized by a nickel filter is used for the measurement. The fiber sample is set in a sample holder composed of aluminum so that the fiber axis is perpendicular to the plane of the $2\theta$ axis of the diffractionmeter. The thickness of the sample is adjusted to about 0.5 mm. The X-ray generator is operated at 40 KV and 90 mA. The diffraction intensity is recorded from 8° to 37° of $2\theta$ by using the scintillation counter at a scanning speed of $2\theta$=1°/min., a chart speed of 1° cm/min and a time constant of 2 seconds with 1/6° divergent slit, a 0.3 mm receiving slit and a 1/6° scattering slit. The full scale deflection of the recorder is set so that the entire diffraction curve remains on the scale and the maximum intensity value exceeds 50% of the full scale.

Generally, the fibers of the present invention are characterized in that they have two major reflections on the equatorial line in the range of from 19° to 24° of $2\theta$. ACS is determined with respect to the reflection of a smaller $2\theta$ value, and RIX is defined by the ratio of the diffraction intensity values of the 2 peaks.

A base line is established by drawing a straight line between 9° and 36° of $2\theta$ on the diffraction intensity curve. A vertical straight line is dropped from the diffraction peak, and the mid-point between the peak and the base line is marked. A horizontal line passing through the mid-point is drawn on the diffraction intensity curve. If the two major reflections are sufficiently separated from each other, this line intersects shoulders of the two peaks of the curve, but if they are not sufficiently separated, the line intersects one shoulder alone. The half value width of the peak is measured. If the line intersects one shoulder alone, the distance between the intersecting point and the mid-point is measured and doubled. If the line intersects two shoulders, the distance between the two shoulders is measured. The measured value is converted to a line breadth in radians (half value width) and the line breadth is corrected according to the formula:

$$\beta = \sqrt{B^2 - b^2}$$

wherein B stands for the observed half value width, b is the broadening constant in radians, which is determined by measuring the half value width of a silicon single crystal at approximately $2\theta$=28°, and $\beta$ designates the corrected half value width.

The apparent crystallite size is given by the formula:

$$ACS = K\lambda/\beta \cos\theta$$

wherein K is taken as one, $\lambda$ is the X-ray wavelength (1.5418 Å), $\beta$ is the corrected half value width and $\theta$ is the Bragg angle.

RIX is defined by the ratio of the distance between the diffraction peak on the larger angle side in $2\theta$ and the base line to the distance between the diffraction peak on the smaller angle side and the base line.

Method of Measurement of Dynamic Mechanical Loss Tangent (tan $\delta$)

The dynamic mechanical loss tangent can be measured by using commercially available apparatus, for example, Rheo-Vibron DDV-IIc manufactured by Toyo Baldwin. The dynamic mechanical loss tangent (tan $\delta$) is measured at a frequency of 110 Hz, in dry air, at a temperature of 30° C. and a relative humidity of 60%.

The present invention will now be described in detail by reference to Examples. In these Examples, all "parts" and "%" are by weight, unless otherwise indicated.

Reference Example

A PPTA polymer was prepared in the following manner according to the low temperature solution polymerization method.

In a polymerization vessel disclosed in Japanese Patent Publication No. 43986/78, 70 parts of anhydrous calcium chloride was dissolved in 1000 parts of N-methylpyrrolidone, and 48.6 parts of p-phenylene diamine was then dissolved. The solution was cooled to 8° C. and 91.4 parts of terephthaloyl dichloride in the powdery state was added to the solution at one time. In several minutes, the polymerization product was solidified to give a cheese-like product. The polymerization product was discharged from the polymerization vessel according to the method disclosed in Japanese Patent Publication No. 43986/78 and immediately transferred into a closed type biaxial kneader, and the polymerization product was finely pulverized in the kneader. Then, the pulverized polymerization product was transferred to a Henschel mixer and combined with water in an amount approximately equal to the amount of the pulverized polymerization product, and the mixture was pulverized, filtered, washed in warm water several times and dried in hot air maintained at 110° C. to obtain 95 parts of a light yellow PPTA polymer having an inherent viscosity of 5.6 dl/g.

Polymers having a different inherent viscosity could easily be obtained by changing the ratio of N-methylpyrrolidone to the monomers (p-phenylene diamine and terephthaloyl dichloride) or the ratio of the two monomers.

Example 1

The PPTA polymer having an inherent viscosity of 5.6 dl/g, which was prepared in the Reference Example, was dissolved in sulfuric acid having a concentration of 99.4% at 70° C., over a period of 2 hours, so that polymer concentration was 18%. The dissolution was carried out in vacuo, and the resulting dope was allowed to be kept stationary for 2 hours, so as to deaerate the dope. This dope was found to be anisotropic. The dope was extruded from a spinneret having 800 fine holes 0.06 mm in diameter. The extrudate was caused to run in air for 10 mm and was then coagulated in 25% dilute sulfuric acid maintained at 5° C. The resulting filament was taken out at a velocity of 120 m/min, and was then subjected to washing and drying in the absence of substantial tension and heat treatment under tension in the apparatus illustrated in FIG. 3. Washing was first conducted with a 15% aqueous solution of caustic soda and then with water. The drying was accomplished by keeping the filament in a drying chamber, maintained at 110° C., for 6 minutes. As the cover belt, there was used a plain-woven fabric of polytetrafluoroethylene capable of resisting the drying temperature. A stainless steel net was used as the net conveyor. At the heat treatment under tension, the ratio of the velocity of the roller for feeding the filament to the heating chamber to the velocity of the roller for withdrawing the filament from the heating chamber was adjusted so that a tension of about 5 g/d was imposed on the filament. A nitrogen gas heated at about 300° C. was fed into the heating chamber. The residence time of the filament in the heating chamber was 10 seconds. The heat-treated filament obtained was a 1180-denier filament characterized by TRIv=0.071, TRIp=−0.009, Nvo=1.611, Npo=2.120, RIX=0.95, ACS=60 Å, OA=14°, and tan δ=0.017, and having a tenacity of 21.0 g/d, an elongation of 2.3% and a Young's modulus of 820 g/d. The bending fatigue-resistant life, as measured according to the above-mentioned method, was 2800 times.

A filament was prepared in the same manner as described above, except that a step of treating the filament with steam maintained at 110° C. was interposed between the above-mentioned washing and drying steps. The obtained filament was characterized by TRIv=0.073, TRIp=−0.005, Nvo=1.617, Npo=2.128, RIX=0.94, ACS=62 Å, OA=15° and tan δ=0.017, and had a tenacity of 21.5 g/d, an elongation of 2.4%, and a Young's modulus of 800 g/d. The bending fatigue-resistant life was 3300 times.

Comparative Example 1

For comparison, fibers were prepared according to the process disclosed in U.S. Pat. No. 3,869,430.

A filament spun in the same manner as described in Example 1 was wound on a bobbin without using the apparatus of the present invention illustrated in FIG. 3. In the wound state, the filament was washed with a 10% aqueous solution of caustic soda and immersed in a washing tank filled with water to effect water washing. Then, while the filament was kept wound on the bobbin, the filament was dried in a hot air drier maintained at 110° C. Then, the filament was subjected to the heat treatment under tension, under the same conditions as described in Example 1.

The obtained filament was characterized by TRIv=0.098, TRIp=+0.045, Nvo=1.581, Npo=2.081, RIX=0.93, ACS=61 Å, and OA=9.3°, and had a tenacity of 20.3 g/d, an elongation of 1.8%, and a Young's modulus of 850 g/d. The bending fatigue-resistant life was 1500 times. Although the Young's modulus of this comparative filament was relatively high, the filament was considerably inferior to the filament obtained in Example 1 in the bending fatigue-resistant life. Thus, it was realized that this filament did not have sufficient toughness.

Comparative Example 2

For comparison, fibers were prepared according to the process disclosed in the non-heat-treatment process in U.S. Pat. No. 4,016,236.

In the same manner as described in Example 1, a filament was spun, washed, and dried by using the apparatus illustrated in FIG. 3. The dried filament was directly wound on the winding device 11 without passing it through the device 10 for the heat treatment under tension. The obtained filament was characterized by TRIv=0.025, TRIp=−0.003, Nvo=1.619, Npo=2.103, RIX=0.76, ACS=41 Å, and OA=27°, and had a tenacity of 22.3 g/d, an elongation of 6.9%, and a Young's modulus of 300 g/d.

This fiber had a high tenacity but was not suitable as a reinforcer for plastics or rubbers where a special resistance to deformation by pulling is required, because the elongation was too high and the Young's modulus was too low.

It was found that the fiber of this Comparative Example was very poor in dimensional stability and the stability of physical properties at high temperatures. When the fiber of this Comparative Example and the fiber of Example 1 were allowed to stand in the absence of tension for 30 minutes in an oven maintained at 200° C., a dimensional shrinkage of 0.08 to 0.11% (three samples) was caused in the former fiber, but no shrinkage was caused in the latter fiber.

Comparative Example 3

An isotropic dope having a polymer concentration of 4.5% was prepared by using PPTA polymer prepared in the same manner as described in the Reference Example, and a filament was prepared from this dope under the same conditions as described in Example 1. The obtained fiber was characterized by TRIv=0.025, TRIp=+0.032, NVo=1.644, Npo=2.071, RIX=0.85, ACS=56 Å, and OA=23°, and had a tenacity of 12.1 g/d, an elongation of 1.9%, and a Young's modulus of 370 g/d. Both the tenacity and the Young's modulus were low. The reason for this is believed to be that the degree of orientation of polymer chains in either the crystalline region or the amorphous region was too low.

Example 2 and Comparative Example 4

A PPTA polymer having an inherent viscosity of 6.1 dl/g, which was prepared according to the method described in the Reference Example, was dissolved in sulfuric acid having a concentration of 99.4%, at 65° C., over a period of 2 hours, so that the polymer concentration was 16%. Then, deaeration was conducted to obtain an anisotropic dope. In the same manner as described in Example 1, the dope was extruded in air, coagulated by passing the extrudate through a so-called double funnel type spinning bath disclosed in Japanese Patent Application Laid-Open Specification No. 144911/78, and then washed. The drying conditions and the conditions of the heat treatment under tension, which was conducted while giving 40 twists per meter to the filament, were changed to obtain various filaments. The heat treatment under tension was carried out by using a hot plate. The preparation conditions and results are indicated in Table 1. All the filaments mentioned in Table 1 were found to have an inherent viscosity of 5.7 to 6.0 dl/g, a monofilament denier of about 1.9 and tan δ of 0.010 to 0.025.

TABLE 1

| Sample | Drying: Temperature (°C.) | Drying: Time (Minutes) | Heat Treatment Under Tension: Tension (g/d) | Heat Treatment Under Tension: Temperature (°C.) | Heat Treatment Under Tension: Time (Seconds) | Fine-Structure of Fiber: TRIv | Fine-Structure of Fiber: Nvo | Fine-Structure of Fiber: RIx | Fine-Structure of Fiber: ACS (A) | Fine-Structure of Fiber: OA | Tenacity (g/d) | Elongation (%) | Physical Properties of Fiber: Young's Modulus (g/d) | Physical Properties of Fiber: Bending Fatigue-Resistance Life (times) |
|---|---|---|---|---|---|---|---|---|---|---|---|---|---|---|
| Example 2-1 | 90 | 20 | 3 | 280 | 20 | 0.073 | 1.614 | 0.88 | 54 | 11° | 21.8 | 2.0 | 870 | 2900 |
| Example 2-2 | 90 | 25 | 1.5 | 400 | 4 | 0.088 | 1.618 | 0.99 | 76 | 15° | 20.1 | 1.9 | 660 | 2400 |
| Example 2-3 | 150 | 5 | 3 | 350 | 8 | 0.075 | 1.610 | 0.90 | 69 | 14° | 21.5 | 2.0 | 680 | 2800 |
| Example 2-4 | 150 | 5 | 10 | 300 | 16 | 0.083 | 1.607 | 1.03 | 59 | 12° | 20.9 | 1.9 | 900 | 2100 |
| Example 2-5 | 150 | 5 | 3 | 250 | 6 | 0.068 | 1.612 | 0.91 | 56 | 13° | 22.3 | 2.1 | 810 | 2600 |
| Comparative Example 4 | 150 | 5 | 3 | 550 | 6 | 0.094 | 1.603 | 1.19 | 94 | 12° | 12.3 | 0.9 | 720 | 620 |

Example 3 and Comparative Example 5

Various dopes differing in the polymer concentration were prepared by using a PPTA polymer having an inherent viscosity of 6.2 dl/g, which was prepared according to the method described in the Reference Example. The dope temperature was adjusted according to the polymer concentration as indicated in Table 2. Each dope was found to be anisotropic. Filaments having a monofilament denier indicated in Table 2 were prepared while adjusting the draft at the spinning step. Drying was carried out at 200° C. for 2 minutes. The dried filaments were treated with saturated steam, maintained at 100° C., in the state where the filaments were deposited on the net conveyor, and then, the filaments were subjected to the heat treatment under tension. Conditions other than those specially mentioned were the same as in Example 1. The preparation conditions and results are indicated in Table 2.

The filament obtained in Comparative Example 5 was excellent in bending fatigue-resistant life, but the tenacity and Young's modulus were very low.

TABLE 2

| Sample | Dope Conditions: Polymer Concentration (%) | Dope Conditions: Temperature (°C.) | Fine-Structure and Physical Properties of Fiber: Monofilament Denier | TRIv | Nvo | RIX | ACS (A) | OA | Tenacity (g/d) | Elongation (%) | Young's Modulus (g/d) | Bending Fatigue-Resistant Life (times) |
|---|---|---|---|---|---|---|---|---|---|---|---|---|
| Comparative Example 5 | 10 | 30 | 2.0 | 0.052 | 1.621 | 0.82 | 62 | 19° | 14.3 | 1.8 | 490 | 3800 |
| Example 3-1 | 12 | 40 | 2.0 | 0.065 | 1.617 | 0.86 | 59 | 16° | 18.6 | 2.1 | 610 | 3500 |
| Example 3-2 | 14 | 55 | 2.4 | 0.073 | 1.615 | 0.86 | 65 | 16° | 19.0 | 1.9 | 650 | 3200 |
| Example 3-3 | 20 | 85 | 2.5 | 0.098 | 1.602 | 0.93 | 68 | 12° | 19.5 | 1.5 | 800 | 1900 |
| Example 3-4 | 20 | 85 | 3.5 | 0.091 | 1.608 | 0.91 | 63 | 14° | 18.4 | 1.6 | 770 | 1800 |

It will be apparent to those skilled in the art that various modifications and variations could be made in the fibers and process of the invention without departing from the scope or spirit of the invention.

What is claimed is:

1. A high Young's modulus fiber consisting essentially of poly-p-phenylene-terephthalamide wherein the tangential refractive index (TRIv) of the fiber by polarized light vibrating in the direction perpendicular to the fiber axis is in the range of from 0.06 to 0.10, the tangential refractive index (TRIp) of the fiber by polarized light vibrating in the direction parallel to the fiber axis is in the range of from −0.020 to +0.020, the central refractive index (Nvo) of the fiber by polarized light vibrating in the direction perpendicular to the fiber axis and the X-ray diffraction intensity ratio (RIX) are in the range satisfying the conditions of the formulae (1) through (4):

$$Nvo \geqq -0.08(RIX)+1.670 \quad (1)$$

$$Nvo \leqq 1.640 \quad (2)$$

$$RIX \geqq 0.85 \quad (3)$$

$$RIX \leqq 1.10 \quad (4),$$

and the apparent crystallite size (ACS in A) of the fiber and the orientation angle (OA in degrees) of the fiber are in the range circumscribed by the four lines (a), (b), (c), and (d) defined by the formulae (5) through (8) as illustrated in FIG. 1:

$$OA \geqq 0.10\ (ACS) + 4.8 \quad (5)$$

$$OA \geqq 0.40\ (ACS) - 19.8 \quad (6)$$

$$OA \leqq 0.05\ (ACS) + 13.3 \quad (7)$$

$$OA \leqq 3\ (ACS) - 146 \quad (8).$$

2. The fiber according to claim 1, wherein the dynamic mechanical loss tangent (tan δ) is in the range of from 0.001 to 0.030.

3. The fiber according to claim 1, wherein the inherent viscosity is at least 5.0 dl/g as measured at a concentration of 0.5 g of polymer in 1 dl of sulfuric acid having a concentration of 98.5% by weight at 30° C.

4. The fiber according to claim 1, wherein the tangential refractive index (TRIv) of the fiber is in the range of from 0.065 to 0.09 and the tangential refractive index (TRIp) of the fiber is in the range of from −0.015 to +0.010.

5. The fiber according to claim 1, wherein the central refractive index (Nvo) of the fiber is in the range of from 1.600 to 1.630.

6. The fiber according to claim 1 or 5 wherein the X-ray diffraction intensity ratio (RIX) is 1.05 or less.

7. The fiber according to claim 1, wherein the ratio of the apparent crystallite size (ACS) to the orientation angle (OA) is 5.4 Å/degree or less.

8. The fiber according to claim 1 or 7, wherein the apparent crystallite size is in the range of from 55 A to 75 A.

9. The fiber according to claim 1, wherein the monofilament denier is less than 3.0.

* * * * *

UNITED STATES PATENT AND TRADEMARK OFFICE

CERTIFICATE OF CORRECTION

PATENT NO. : 4,374,978

DATED : February 22, 1983

INVENTOR(S) : TAKASHI FUJIWARA ET AL

It is certified that error appears in the above—identified patent and that said Letters Patent is hereby corrected as shown below:

Column 24, claim 1, line 18, change "(ACS in A)" to -- (ACS in Å)--.

Column 26, claim 8, line 2, change "55 A" to --55 Å--.

Column 26, claim 8, line 3, change "75 A" to --75 Å--.

Signed and Sealed this

Third Day of May 1983

[SEAL]

*Attest:*

GERALD J. MOSSINGHOFF

*Attesting Officer*

*Commissioner of Patents and Trademarks*